US005465876A

United States Patent [19]

Crisci

[11] Patent Number: 5,465,876

[45] Date of Patent: Nov. 14, 1995

[54] CONTAINER AND CLOSURE RESEALABLE BOTTLE CAP WITH PUSH PULL CLOSURE

[75] Inventor: Robert E. Crisci, New Castle, Pa.

[73] Assignee: Portola Packaging, Inc., San Jose, Calif.

[21] Appl. No.: 258,201

[22] Filed: Jun. 9, 1994

[51] Int. Cl.[6] ..... B67D 5/32

[52] U.S. Cl. ..... 222/153.1; 222/525; 222/541.9; 215/253; 215/356

[58] Field of Search ..... 222/153, 521, 222/524, 525, 541; 215/253, 256, 258

[56] References Cited

U.S. PATENT DOCUMENTS

| | | | |
|---|---|---|---|
| 3,504,818 | 4/1970 | Crisci et al. | 215/252 |
| 3,682,345 | 8/1972 | Baugh | 215/43 R |
| 3,902,621 | 9/1975 | Hidding | 215/216 |
| 3,963,139 | 6/1976 | Gach | 215/216 |
| 3,980,195 | 9/1976 | Fillmore | 215/256 |
| 4,034,882 | 7/1977 | Wright | 215/217 |
| 4,053,077 | 10/1977 | De Felice | 215/217 |
| 4,084,716 | 4/1978 | Bogert | 215/217 |
| 4,500,016 | 2/1985 | Funfstuck | 222/153 |
| 4,561,553 | 12/1985 | Crisci | 215/256 |
| 4,589,561 | 5/1986 | Crisci | 215/256 |
| 4,749,103 | 6/1988 | Barriac | 222/525 X |
| 4,801,032 | 1/1989 | Crisci | 215/256 |
| 4,813,577 | 3/1989 | Carow | 222/525 X |
| 4,826,055 | 5/1989 | Stull | 222/525 X |
| 4,927,065 | 5/1990 | Beck | 222/525 X |
| 5,104,008 | 4/1992 | Crisci | 222/153 |
| 5,105,960 | 4/1992 | Crisci et al. | 215/329 |

*Primary Examiner*—Andres Kashnikow
*Assistant Examiner*—Kenneth Bomberg
*Attorney, Agent, or Firm*—Julian Caplan; Flehr, Hohbach, Test, Albritton & Herbert

[57] ABSTRACT

A tamper evident resealable cap for use on a bottle, the cap having an upstanding pour spout registering with an opening in the center of the cap and a smaller diameter plug positioned thereabove on a plurality of upwardly angled legs on the pour spout. The cap having a flexible annular ring attached to the cap by a plurality of radially extending frangible elements with the plurality of circumferentially spaced radially inwardly extending angular projections arranged for registration with a neck portion on the bottle to prevent rotation in one direction without removal of the ring.

6 Claims, 1 Drawing Sheet

CONTAINER AND CLOSURE RESEALABLE BOTTLE CAP WITH PUSH PULL CLOSURE

BACKGROUND OF THE INVENTION

1. Technical Field

This device relates to tamper indicating closures for containers and the like requiring a push pull resealable tamper evident spout.

2. Description of Prior Art

Prior art closures of this type may be seen in U.S. Pat. Nos. 5,104,008, 5,105,967, 4,940,003, 4,801,032, 4,589,561, 4,561,553, 4,500,016, 4,469,253, 3,902,621 and 4,084,716 and 4,053,077 and U.S. Pat. Nos. 4,034,882, 3,980,195, 3,963,139, 3,902,921, 3,682,345, 3,504,818.

SUMMARY OF THE INVENTION

A dual tamper evident resealable closure for bottles that requires a dual tamper evident configuration defining a first tamper evident ring on the closure adjacent the neck portion of the bottle to indicate registering tampering of the enclosure of the closure and a second tamper evident configuration on a push pull resealable pour spout having an opening therein which is partially closed by a second top having a secondary opening therein and a plug spaced thereabove by upward angled legs formed integral with the closure.

DESCRIPTION OF THE PREFERRED EMBODIMENT

Figure 1:
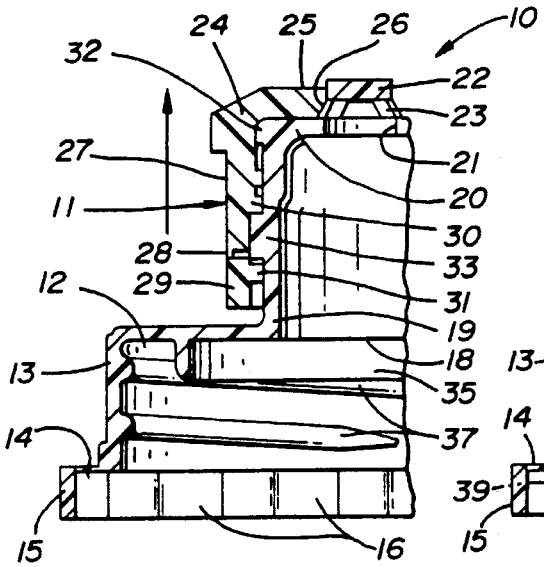
FIG. 1 is a vertical cross-section through a portion of the resealable bottle cap with the push pull pour spout in a closed position.
Figure 3:
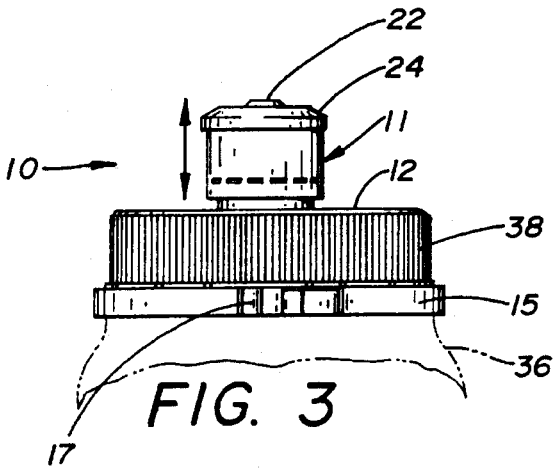
FIG. 3 is a side elevation of the resealable bottle cap.

Referring to FIGS. 1 and 3 of the drawings, a resealable bottle cap 10 can be seen having a push pull secondary closure 11 thereon and comprising a top portion 12 with an integral depending annular flange 13 extending therefrom. A plurality of circumferentially spaced frangible elements 14 extend from the lower edge of the depending flange 13 to a broken away tamper evident ring 15 integrally molded with the closure. The annular ring 15 is of a larger diameter than the annular flange 13 of the closure and the ring 15 has a plurality of circumferentially spaced inwardly facing angular projection 16.

Figure 4:
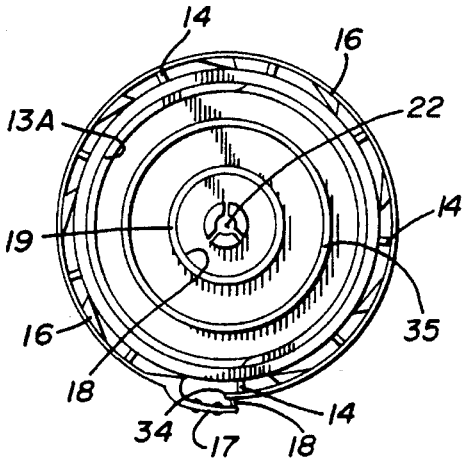
FIG. 4 is a bottom plan view of the resealable bottle cap.

Referring to FIGS. 1 and 4 of the drawings it will be seen that the angular projections 16 are circumferentially spaced about the inner surface of said ring 15 and are positioned so that they incline in a counter clockwise direction. The ring 15 has a pull tear tab 17 thereon that extends outwardly from the ring 15 overlapping a portion thereof. A frangible element 18 is secured to the free end of the tear tab 17 securing same to the remaining portion of the ring 15. The tear tab 17 allows the rings 15 to be selectively removed from the annular flange 13. Referring now to FIG. 1 of the drawings, it will be seen that an opening 18A is formed in the center of the top portion 12 of the cap 10 with an upstanding cylindrical pour spout 19 positioned in registry with the opening 18. The upper end of the pour spout 19 having a secondary top portion 20 thereon which is apertured at 21. A plug 22 is positioned on the secondary top portion 20 in spaced relation to the aperture 21 by a plurality of circumferentially spaced angularly arranged legs 23. A push pull top cap 24 is positioned on the upstanding cylindrical pour spout 19 having a top portion 25 with a central opening 26 therein which registers with the plug 22 to form a secondary closure when the top portion 24 is in closed position as illustrated in FIG. 1 and resting on the secondary top 20 of the upstanding cylindrical pour spout 19. It will be seen that the top cap 24 has a depending cylindrical body member 27 with a plurality of annularly spaced frangible elements 28 connected on its lower perimeter edge to a secondary ring 29. The cylindrical body member 27 has a pair of vertically spaced inturned annular flanges 30 which slideably engage the outer surface of the upstanding cylindrical pour spout 19. The secondary ring 29 also has an internal annular flange 31 which is slideably engaged at the exterior of the upstanding cylindrical pour spout 19. The upstanding cylindrical pour spout 19 has two outwardly annular flanges 32 and 33 respectively on the exterior of the upstanding cylindrical pour spout 19. The flange 32 being oppositely disposed with respect to the secondary top 20 and the out-turned flanged 33 positioned therebelow, above the top 12 of the cap 10 and being oppositely disposed and between the annular flanges 32 and 33 on the cylindrical body member 27.

Figure 2:
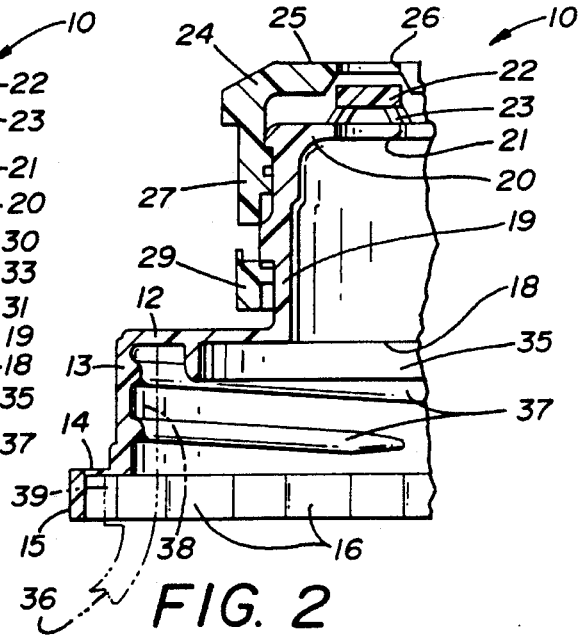
FIG. 2 is a vertical cross-section through a portion of the resealable bottle cap with the push pull top in an open position.
Figure 5:
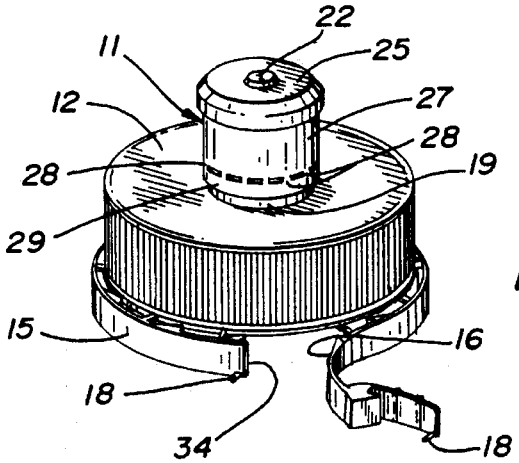
FIG. 5 is a perspective view of the cap portion of the resealable bottle cap with a portion of a first tamper evident ring partially released therefrom.

In assembled form illustrated in FIGS. 3, 4 and 5 of the drawings the secondary ring 29 joined by the frangible elements 28 to the cylindrical body member 27 of the top cap 24 is incapable of moving upwardly due to the interengagement of the inturned flange 31 thereon with the out-turned flange 33 on the cylindrical pour spout 19 and the cylindrical body member 27 of the top cap 24 is encapable of vertical movement such as necessary to move the apertured top 24 thereabove the plug 22 until sufficient force is applied to the top cap 24 to break away the frangible elements 28 whereby the top cap 24 can move to the position illustrated in FIG. 2 wherein the opening 26 therein moves upwardly and away from the plug 22. The inturned annular flanges 30 on the cylindrical body member 27 cannot move above the out-turned annular flange 32 on the the upstanding cylinder pour spout 19 so that the push pull top cap of the bottle cap is child safe as it is not removable therefrom.

Referring to FIG. 4 of the drawings, it will be seen that the ring 15 has one of the frangible elements 14 positioned inwardly of a split at 34 therein with the hereinbefore described tear tabs 17 extending from the opposite end of the ring 15.

An annular sealing flange 35 depends from the inside surface of the top portion 12 opposite a bottle neck 36 shown in broken lines in FIGS. 2 and 3 of the drawings. A single spiral rib 37 extends around the inside surface of the depending annular flange 13 just above the annular ring 15 and terminates opposite annular sealing flange 35 in spaced relation to the top portion 12. The spiral thread 37 forms a frictional engagement with a registering spiral thread 38 on the hereinbefore described bottle neck 36.

Referring to FIG. 3 of the drawings, a side elevation of the resealable tamper evident bottle cap 10 with push pull closure 11 may be seen in its assembled condition as hereinbefore described and disclosed in FIGS. 1 and 2 of the drawings illustrating an outside ribbed surface 38 on the depending annular flange 13.

The bottle neck 36 shown in broken lines in FIGS. 2 and 3 of the drawings has a plurality of ratchet sections 39 arranged for interlocking registration with the angular projection 16 on the annular ring 15 when the cap 10 is rotated clockwise and moved downwardly to position the annular ring 15 and the ratchet sections 39 in side by side relation as is well known within the art. The annular ring 15 is flexible so that when the inward forcing angular projection 16 therein moves in position adjacent the ratchet sections 39 rotation of the closure with the annular ring will cause the ring 15 to move outwardly and slide over the ratchet sections 39 due to their configuration and the circumferentially spaced inwardly facing angular portion 16.

To remove the cap 10 from the bottle neck 36, a counter clockwise rotation of the cap is required which will accordingly engage the respective angular portion 16 and the selected ratchet sections 39 breaking the frangible elements 14 from the annular depending flange 15 hereinbefore described. Alternately, the pull tab 17 can be forced outwardly from the cap 10 initially breaking the frangible element 18 and then sequentially breaking additional frangible elements 14 as required and illustrated in FIG. 5 of the drawings.

It will thus be seen that a resealable bottle cap of the invention with a push pull closure and a threaded tamper evident flexible plastic closure has been illustrated and described and though one embodiment of the present invention has been illustrated, it will be apparent to those skilled in the art that various changes and modifications may be made therein, therefore

I claim:

1. An improvement in a resilient molded plastic resealable bottle cap for a bottle having a neck surrounding an opening, said neck having ratchet sections and a spiral thread extending outwardly of said neck; the improvement comprising in combination, a cap having a top portion, an annularly depending flange depending from said top portion, a spiral thread in said annular depending flange, a plurality of circumferentially spaced radially outwardly extending frangible elements on said depending flange, said frangible elements having outer ends spaced from said depending a thin flexible annular ring coupled to said outer ends of said frangible elements and positioned in spaced relation to said depending flange, said flexible annular ring having spaced first and second ends, said second end extending radially outwardly of and overlapping said first end, said second end being frangibly attached to said first end to define a tab for removal of said ring from said depending flange, a plurality of circumferentially spaced radially inwardly extending angular projections on said flexible annular ring registerable with said ratchet sections positioned on said neck portion, an internal pour spout on said top portion communicating with an opening in said top portion, said pour spout having a secondary top portion having an aperture formed therein, and means for positioning a plug in spaced relation to said secondary top portion and said aperture, a top cap movably positioned on said pouring spout, said top cap having an opening registering with said plug defining a closure when said top cap is in a first position, a ring having a plurality of frangible elements integrally connecting said ring with said top cap in said first position, a flange on said pour spout retaining said ring in said first position when said top cap is moved away from said first position to a second position locating said opening in said top cap in spaced relation to said plug.

2. The improvement in a resilient molded plastic resealable bottle cap in combination of claim 1 wherein said means for positioning said plug in spaced relation to said secondary top portion and said aperture comprises multiple circumferentially spaced legs extending from said secondary top portion.

3. The improvement in a resilient molded plastic resealable bottle cap in combination of claim 1 wherein said upstanding pour spout has a tubular body of a known outer diameter, and said top cap has a cylindrical body, the inner diameter of which is greater than said known outer diameter of said tubular body.

4. A combination of a resilient molded plastic resealable bottle cap having a top portion, an annular depending flange depending from said top portion, a tamper evident thin flexible annular ring on a plurality of circumferentially spaced radially outwardly extending frangible elements on said depending flange, said flexible annular ring having spaced first and second ends, said second end extending radially outwardly of and overlapping said first end, said second end being frangibly attached to said first end to define a tab for removal of said ring from said depending flange, a plurality of circumferentially spaced radially inwardly extending angular projections on said flexible annular ring, said angular projections being spaced circumferentially from said frangible elements and a resealable pour spout on said top portion, said pour spout having a secondary top portion having an aperture registerable with said pour spout, a closure plug in spaced relation from said secondary top portion, a top cap movably positioned on said pour spout having an opening registering with said plug and defining a resealable closure when said top cap is in a first position, a tamper evident ring having a plurality of frangible elements integrally connecting said ring with said top cap in said first position, an annular flange on said pour spout retaining said ring in said first position when said top cap is moved away from said first position.

5. The combination of a resilient molded plastic resealable bottle cap in claim 4 wherein said closure plug has a plurality of circumferentially spaced legs extending therefrom to said secondary top portion about said aperture in said secondary top portion.

6. The combination of a resilient molded plastic resealable bottle cap in claim 4 wherein said pour spout has a tubular body of a known outer diameter extending upwardly from said top portion, and said top cap has a cylindrical body, the inner diameter of which is greater than said outer diameter of said tubular body.

* * * * *